US009674596B2

(12) United States Patent
Briggs et al.

(10) Patent No.: US 9,674,596 B2
(45) Date of Patent: Jun. 6, 2017

(54) HEADPHONE WITH SELECTABLE AMBIENT SOUND ADMISSION

(71) Applicant: International Business Machines Corporation, Armonk, NY (US)

(72) Inventors: Simon A. Briggs, Winchester (GB); James K. Hook, Eastleigh (GB); Hamish C. Hunt, Middlesex (GB); Nicholas K. Lincoln, Hampshire (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/930,684

(22) Filed: Nov. 3, 2015

(65) Prior Publication Data

US 2017/0127168 A1 May 4, 2017

(51) Int. Cl.

| | |
|---|---|
| ***H04R 25/00*** | (2006.01) |
| ***H04R 1/10*** | (2006.01) |
| ***H04R 5/033*** | (2006.01) |

(52) U.S. Cl.

CPC ..... *H04R 1/1008* (2013.01); *H04R 1/1041* (2013.01); *H04R 1/1058* (2013.01);

(Continued)

(58) Field of Classification Search

CPC ..... H04R 1/10; H04R 1/1008; H04R 1/1041; H04R 1/1083; H04R 5/033;

(Continued)

(56) References Cited

U.S. PATENT DOCUMENTS 4,005,278 A * 1/1977 Gorike ..... H04R 5/033 181/137
4,529,057 A * 7/1985 Telford ..... A61F 11/14 128/868

(Continued)

FOREIGN PATENT DOCUMENTS

WO 2014168685 A2 10/2014

OTHER PUBLICATIONS

Wikipedia, "Auxetics", From Wikipedia, the free encyclopedia, https://en.wikipedia.org/wiki/Auxetics, Printed on Sep. 29, 2015, pp. 1-3.

Disclosed Anonymously, "Method and System for Allowing One or More Sounds to Pass Through Noise-Cancelling Audio Reproduction Device", An IP.com Prior Art Database Technical Disclosure, IP.com No. 000216395, IP.com Electronic Publication: Apr. 3, 2012, 6 pages.

(Continued)

*Primary Examiner* — Huyen D Le
(74) *Attorney, Agent, or Firm* — Michael P. O'Keefe

(57) ABSTRACT

A headphone apparatus with selectable sound admission is described including an earphone apparatus. The earphone apparatus includes a housing being shaped to substantially cover an ear of a wearer when the headphone apparatus is worn, a sound emitting component within the housing, a baffle member formed of a flexible, sound-insulating material in the form of an open-ended tube having an outer open end and an inner open end with a central axis through the tube, the baffle member has an open arrangement with the tube providing an open channel and a closed arrangement in which the baffle member is twisted about the central axis to form a closed neck in the baffle member thereby preventing sound from transmission through the tube, and an operating mechanism for operating switching of the baffle member between the open and closed arrangements.

20 Claims, 14 Drawing Sheets

(52) U.S. Cl.
CPC ..... *H04R 1/1066* (2013.01); *H04R 5/033* (2013.01); *H04R 2201/105* (2013.01); *H04R 2460/09* (2013.01); *H04R 2460/13* (2013.01)

(58) Field of Classification Search
CPC ..... H04R 2201/105; H04R 2201/107; H04R 2460/09; H04R 2460/11; H04R 1/1058; H04R 1/1066; H04R 2460/13; A61F 11/10; A61F 11/14
USPC ..... 381/72, 370, 371, 373, 374, 382, 384; 379/430, 431, 432; 128/866, 868; 181/129, 130, 135
See application file for complete search history.

(56) References Cited

U.S. PATENT DOCUMENTS

| | | | | |
|---|---|---|---|---|
| 5,464,189 | A * | 11/1995 | Li | B65D 90/56 137/614.14 |
| 7,391,878 | B2 * | 6/2008 | Liao | H04R 5/033 381/370 |
| 8,295,505 | B2 | 10/2012 | Weinans et al. | |
| 8,335,335 | B2 | 12/2012 | Reiss et al. | |
| 8,379,872 | B2 | 2/2013 | Parkins | |
| 2001/0046304 | A1 | 11/2001 | Rast | |
| 2005/0105755 | A1 | 5/2005 | Yueh | |
| 2012/0207320 | A1 | 8/2012 | Avital | |
| 2013/0136294 | A1 | 5/2013 | Lee et al. | |

OTHER PUBLICATIONS

Liu, "Literature Review: Materials with Negative Poisson's Ratios and Potential Applications to Aerospace and Defence", Australian Government, Department of Defence, Defence Science and Technology Organisation, Air Vehicles Division, DSTO-GD-0472, Aug. 2006, 47 pages.

Narahari, "Noise Cancellation in Headphones", M.Tech. credit seminar report, Electronic Systems Group, EE Dept, IIT Bombay, submitted Nov. 2003, 13 pages.

Robertson, "Panasonic's bone conduction headphones pump sound directly into your skull (hands-on)", The Verge, Jan. 9, 2013, 3 pages.

Sennheiser, "PXC 450", PXC450_517600_0806_SP6.book Seite 1 Donnerstag, 13. Sep. 2007, Instruction Manual, Downloaded from www.Manualslib.com, 20 pages.

Wikipedia, "Shutter (photography)", From Wikipedia, the free encyclopedia, https://en.wikipedia.org/wiki/Shutter_(photography), Printed on Sep. 29, 2015, 7 pages.

Lakes, "Meaning of Poisson's ratio", What is Poisson's ratio?, http://silver.neep.wisc.edu/~lakes/PoissonIntro.html, Printed on Sep. 29, 2015, 3 pages.

Wikipedia, "Noise-cancelling headphones", From Wikipedia, the free encyclopedia, https://en.wikipedia.org/wiki/Noise-cancelling_headphones, Printed on Sep. 29, 2015, 3 pages.

* cited by examiner

HEADPHONE WITH SELECTABLE AMBIENT SOUND ADMISSION

BACKGROUND

The present invention relates to a headphone apparatus, and more specifically, to a headphone apparatus with selectable ambient sound admission.

Headphones have earphone housings which rest over a wearer's ears. People may listen to audio in private and public environments using headphones. Headphones provide good sound insulation and the wearer may not hear noises outside the headphones.

When the wearer or user may want to listen to noises outside the headphones during conversions with others, while answering the phone, or crossing the road, among other things, the headphones may need to be removed to leave the ears unobstructed and enable the wearer to hear ambient sounds. This can be a nuisance to the headphone wearer and can result in wear and tear of the headphones due to the user's frequent removal and putting the earphones back on.

SUMMARY

According to an embodiment of the present invention there is provided a headphone apparatus including an earphone apparatus comprising: a housing being shaped to substantially cover an ear of a wearer or user when the headphone apparatus is worn; a sound emitting component disposed within the housing; a baffle member formed of a flexible, sound-insulating material in the form of an open-ended tube having an outer open end and an inner open end with a central axis through the tube, the baffle member has an open arrangement with the tube providing an open channel and a closed arrangement in which the baffle member is twisted about the central axis to form a closed neck in the baffle member thereby preventing sound from transmission through the tube; and an operating mechanism for operating switching of the baffle member between the open and closed arrangements.

According to another embodiment of the present invention there is provided a method of operating a headphone apparatus, including: selectively operating an operating mechanism of an earphone apparatus to open or close a channel to allow or prevent sound to pass through the earphone apparatus; the operating mechanism rotating a baffle member provided within the earphone apparatus between an open arrangement and a closed arrangement wherein the baffle member is formed of a flexible, sound-insulating material in the form of an open-ended tube having an outer open end and an inner open end with a central axis through the tube, the baffle member having an open arrangement with the tube providing an open channel and a closed arrangement in which the baffle member is twisted about the central axis to form a closed neck in the baffle member thereby preventing sound from transmission through the tube.

According to yet another embodiment of the present invention there is provided an earphone insert including a baffle member formed of a flexible, sound-insulating material in the form of an open-ended tube having an outer open end and an inner open end with a central axis through the tube, the baffle member has an open arrangement with the tube providing an open channel and a closed arrangement in which the baffle member is twisted about the central axis to form a closed neck in the baffle member thereby preventing sound from transmission through the tube.

BRIEF DESCRIPTION OF THE DRAWINGS

The following detailed description, given by way of example and not intended to limit the invention solely thereto, will best be appreciated in conjunction with the accompanying drawings, in which.

The drawings are not necessarily to scale. The drawings are merely schematic representations, not intended to portray specific parameters of the invention. The drawings are intended to depict only typical embodiments of the invention. In the drawings, like numbering represents like elements.

DETAILED DESCRIPTION

Figure 1A:
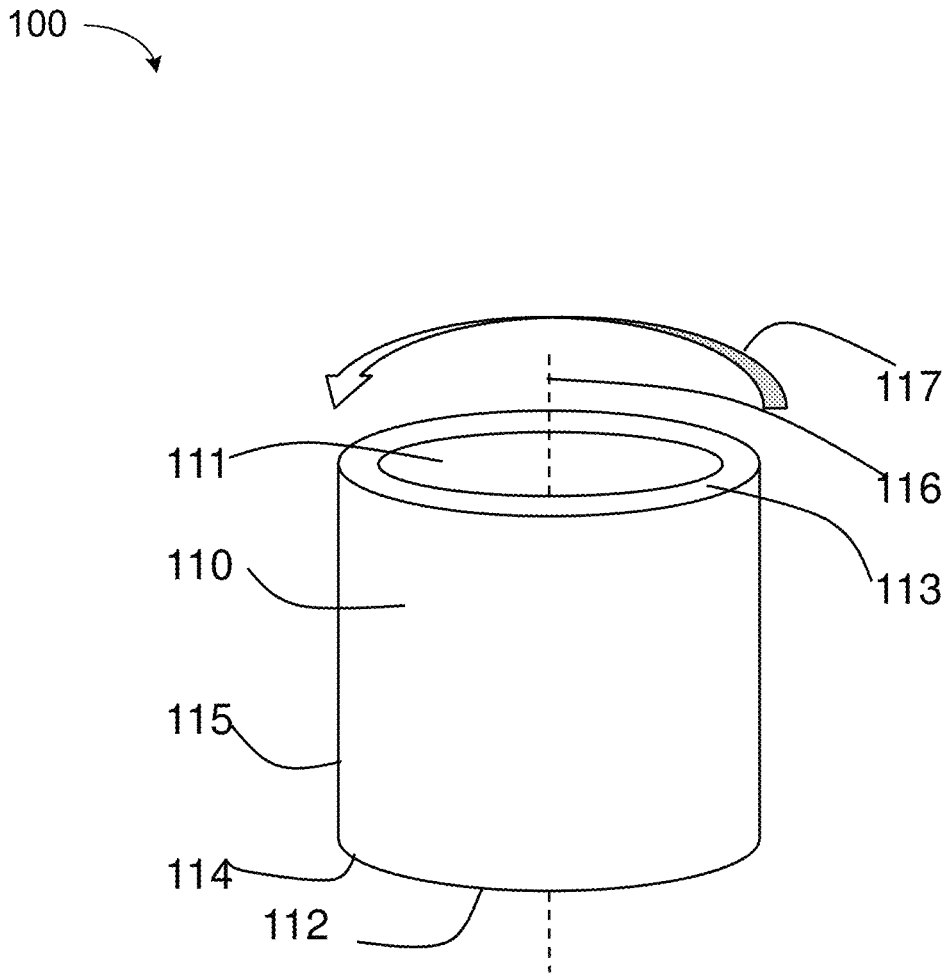
FIGS. 1A to 1C are schematic diagrams of a baffle member of an earphone apparatus in various different arrangements according to an exemplary embodiment.

A headphone apparatus is described with two earphone apparatus that generally surround a wearer's or user's ears and are connected by a band across the wearer's head. One or both of the earphone apparatus may have the described arrangement, which enables the wearer to selectively open or close a baffle member. The baffle member provides sound insulation from the ambient sound of the earphone apparatus when closed, but allows the ingress or admission of ambient sound through the earphone apparatus to the wearer's ear when open.

A baffle member is provided in the earphone apparatus, which can be selectively changed between two arrangements, with an optional third arrangement. In an open arrangement, the baffle member is provided in an open orientation such that an open channel is provided to the wearer's ear. In a closed arrangement, the baffle member is provided in a closed orientation such that the open channel is closed by a portion of the baffle member. An additional optional arrangement may have the channel partially open.

The term baffle member is used to describe an item that forms a barrier that impedes the transmission of sound when closed.

The baffle member may be provided as an open-ended tube or conduit. This may be in the form of an open-ended cylinder or open-ended prism having polygon-shaped open ends. In the open arrangement, the baffle member is in an open state with a central channel open through the baffle member for transmission of sound. In the closed arrangement, the baffle member is twisted such that a closed neck is formed, which may be mid-way between the open ends of the baffle member. This forms a closed state as the material of the baffle member at the neck closes the central channel and prevents transmission of sound.

In the case of the baffle member being an open-ended cylinder, the twisting results in two opposing cones with the neck at the apexes of the cones. In the case of the baffle member being an open-ended prism, the twisting results in a twisted prism.

The baffle member is twisted by relative rotation of the two open-ends of the baffle member about the cylindrical axis in opposite directions. This twisting action may be carried out by rotation of one of the open ends of the baffle member or by rotation of both ends in opposite directions. This twisting action when carried out for approximately 180 degrees of relative rotation results in a closed neck. Further description is provided of this arrangement as applied to a cylinder in relation to FIGS. 1A and 1B.

In addition, the optional third arrangement is obtained by inverting one of the cones or half of the twisted prism of the closed arrangement over the other cone or other half of the twisted prism to form a single, double-sided closed arrangement, thereby increasing the sound insulation and reducing the height of the baffle member. Further description is provided in relation to FIG. 1C. This double-sided closed arrangement may be further collapsed to form a double-layered disk.

The baffle member may be formed of a flexible, sound-insulating material. The material may also be stretchable to accommodate the required change in shape of the baffle member.

The baffle member may be formed of an appropriate auxetic material, such as a polymer foam, although other materials may also be used. Auxetic materials are a family of materials that have a negative Poisson ration. When stretched, auxetic materials become thicker perpendicular to the applied force. This occurs due to their particular internal structure and the way this deforms when the sample is uniaxially loaded.

In addition to the baffle member that opens and closes the channel of sound to the wearer's ear, there may also be a shutter provided at the outer open end of the baffle member. The shutter may open and close during the same operation as the movement from the open arrangement of the baffle member to the closed arrangement of the baffle member. In one embodiment, the shutter may be a diaphragm shutter that opens and closes with the rotation of the open end of the baffle member.

In an embodiment, the diaphragm shutter may have a polygon shape formed by the leaves of the shutter corresponding to the polyhedral shape of the prism of the baffle member.

Embodiments of earphone apparatus are described having alternative sound emitting arrangements. In an embodiment, a sound emitting component is a bone conduction component for conduction of sound to an inner-ear of the wearer through the bones of the wearer's skull. In another embodiment, a sound emitting component is a sound speaker which may be offset from the wearer's ear to enable the open channel of the baffle member to reach the ear. Other forms of sound emission may also be used.

Figure 1B:
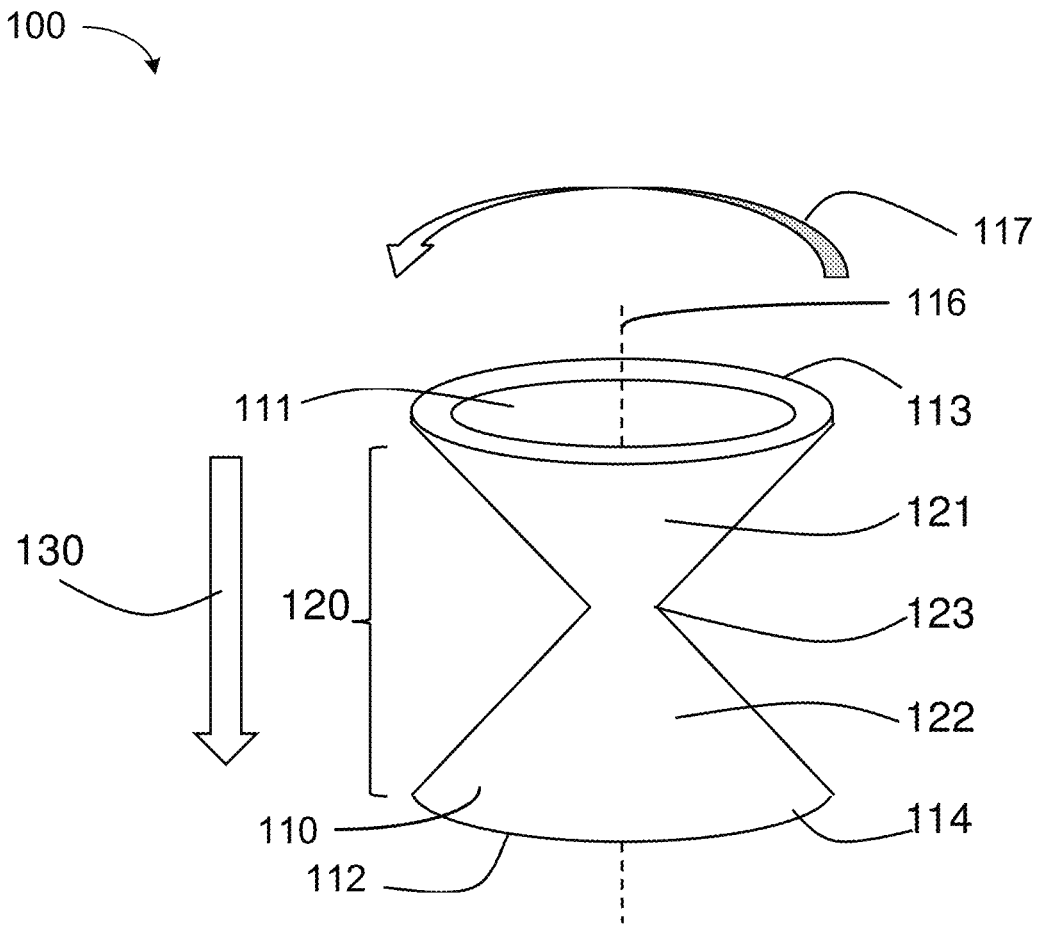
Figure 1C:
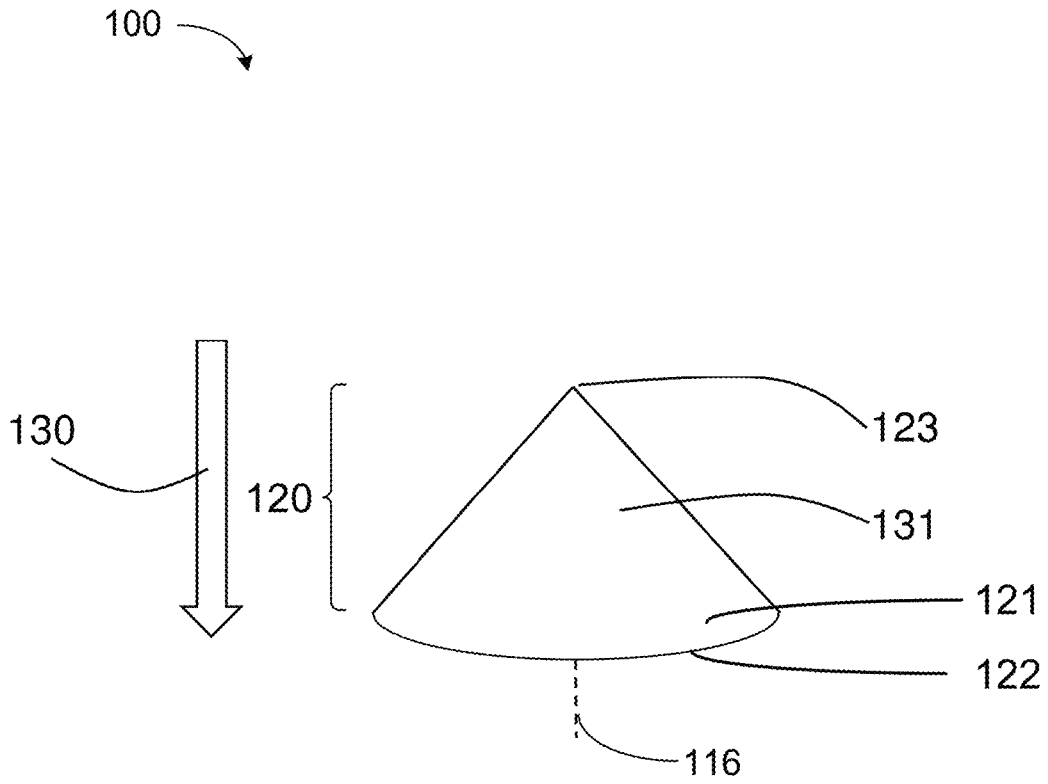

Referring to FIGS. 1A to 1C, schematic diagrams show the operation of the described baffle member.

FIG. 1A shows a baffle member 100 as an open-ended cylinder 110 having a first open end 111 with a rim 113 and a second open end 112 with a rim 114. The cylinder 110 may have walls 115 of an appropriate thickness of material and may have an axis 116 longitudinally through the cylinder 110. A rotation 117 is shown.

FIG. 1B shows the baffle member 100 when it has been twisted or rotated. The twisting may be carried out by rotation 117 of one of the rims 113, 114 of the open ends 111, 112 of the cylinder 110 about the axis 116 of the cylinder 110 whilst the rim 113, 114 of the other open end 111, 112 remains stationary in fixed position. The rotating rim may be rotated 180 degrees. In an alternative operation, both rims 113, 114 of the open ends 111, 112 may be rotated in opposite directions. In the closed position the rims 113, 114 may be 180 degrees out of phase.

This forms a double cone 120 formed of a first cone 121 and a second cone 122 that close up the original cylinder 110 at the twisted, joined apex 123 of the cones. A force 130 is shown.

FIG. 1C shows that, in a preferred embodiment, the double cone 120 of FIG. 1B may be "doubled up" into a single cone 131 by exerting the force 130 along the axis 116 and inverting the first cone 121 down on top of the second cone 122 allowing for more mechanical stability and increased insulating properties of the double walls of the resultant cone 131.

Figure 2A:
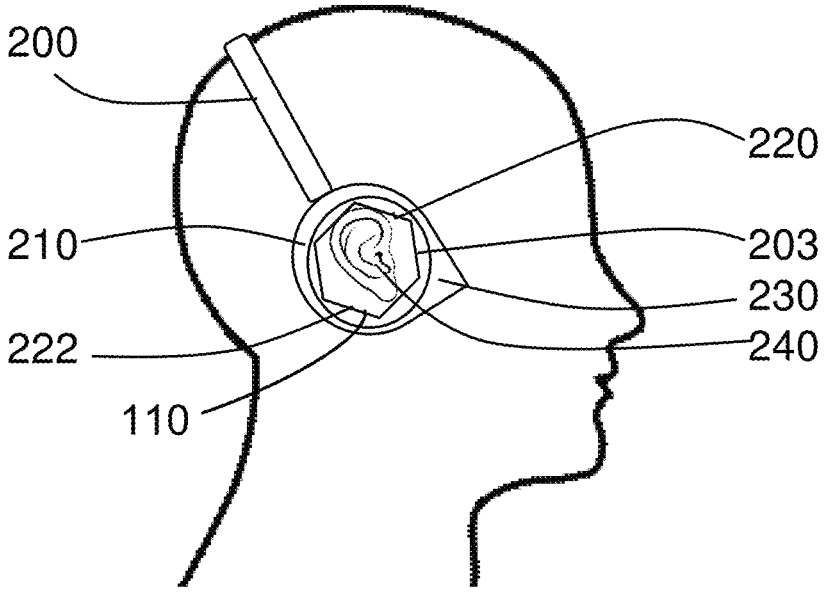
FIG. 2A to 2C are side views of an earphone apparatus in three different arrangements, in accordance to an exemplary embodiment.
Figure 2B:
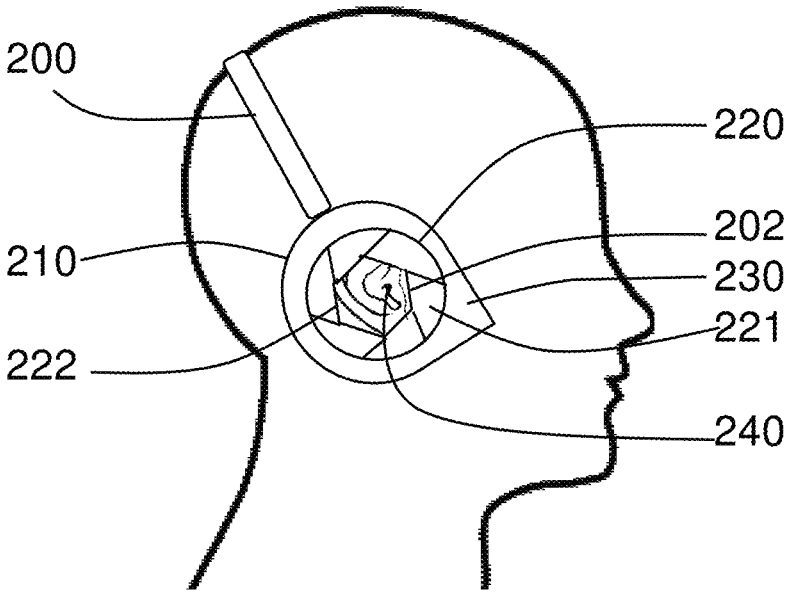
Figure 2C:
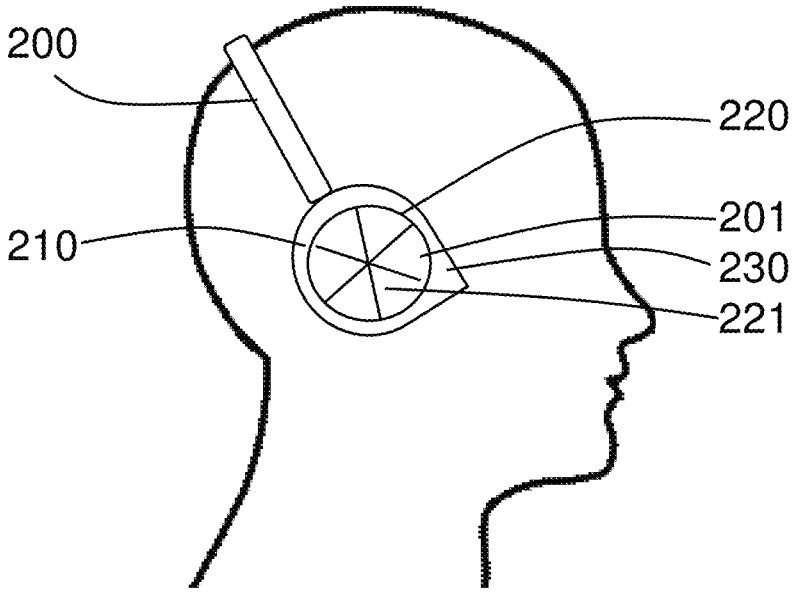

Referring to FIGS. 2A to 2C, side views of a headphone apparatus 200, including an earphone apparatus 210, are shown in different arrangements. Also shown is a housing extension 230 which houses the sound-emitting component which may be in the form of a bone conducting component, offset sound speakers, or specially configured conventional air acoustics which are able to change the air pressure in some way.

FIG. 2A shows the side view of the headphone apparatus 200 and the earphone apparatus 210. The earphone apparatus 210 shows a shutter in the form of a diaphragm shutter 220. The diaphragm shutter 220 may be provided adjacent to an outer open end of the baffle member 100 such that rotation of the baffle member results in opening and closing of the diaphragm shutter 220. This is shown in more detail in FIGS. 3A to 3C. The diaphragm shutter 220 is shown in a fully open position 203 in which leaves of the diaphragm shutter 220 have been rotated so that they are completely retracted and the opening 222 is at its widest position. The opening 222 provides a channel for ambient sound to travel to an ear 240 of a wearer of the headphone apparatus 200. The housing extension 230 is also shown.

FIG. 2B shows the side view of the headphone apparatus 200 and the earphone apparatus 210. The earphone apparatus 210 shows the diaphragm shutter 220 in a partially open/closed position 202 in which the leaves 221 of the diaphragm shutter have rotated to expose only a small opening 222 in the diaphragm shutter 220. The opening 222 provides a partial channel for ambient sound to travel to an ear 240 of a wearer of the headphone apparatus 200. The housing extension 230 is also shown.

FIG. 2C shows the shows the side view of the headphone apparatus 200 and the earphone apparatus 210. The earphone apparatus 210 diaphragm shutter 220 in a closed position 201 with the leaves 221 of the diaphragm shutter 220 in a closed position. The diaphragm shutter 220 may be formed of a suitable solid material such as a plastic or metal alloy. The diaphragm shutter 220 may contribute to the sound insulation against ambient sound when closed. The housing extension 230 is also shown.

Figure 3A:
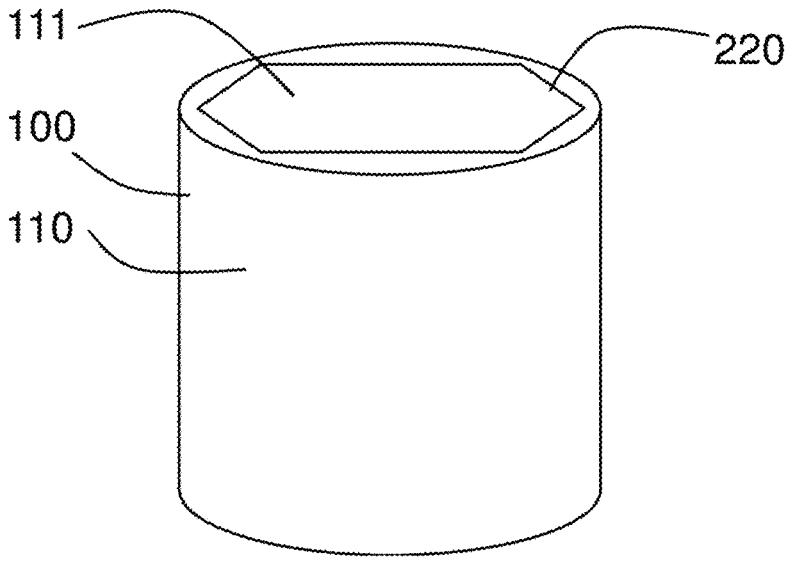
FIGS. 3A to 3C are perspective representations of a combined baffle member and shutter in three different arrangements in accordance to an exemplary embodiment.
Figure 3B:
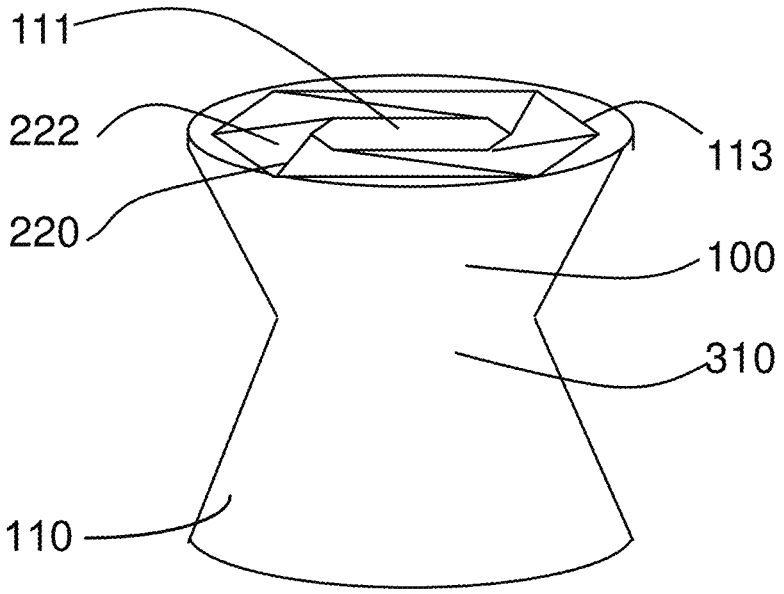
Figure 3C:
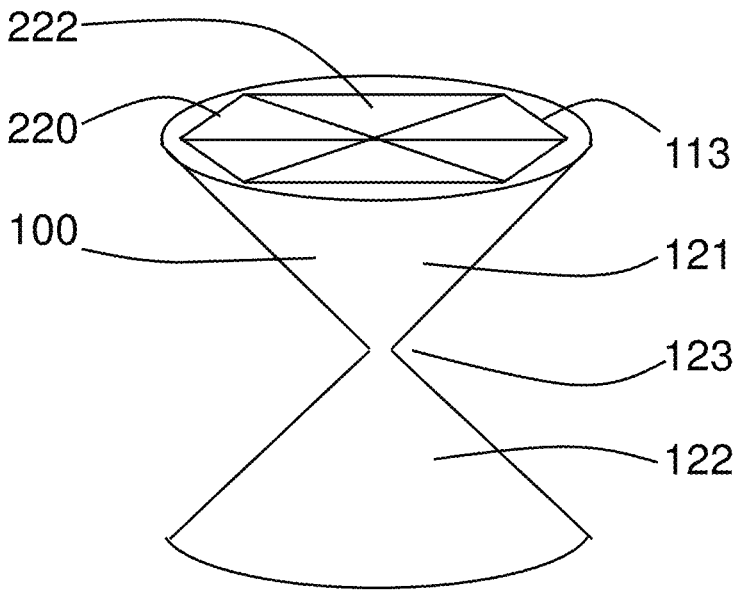

FIGS. 3A to 3C show the combined operation of the baffle member 100 and the diaphragm shutter 220.

FIG. 3A shows the baffle member 100 in an open arrangement as a cylinder 110 having a diaphragm shutter 220 disposed at the first open end 111 of the cylinder 110. In this position, the diaphragm shutter 220 is open with its leaves retracted.

FIG. 3B shows the baffle member 100 in an intermediate arrangement as a partially twisted cylinder 310. The leaves 222 of the diaphragm shutter 220 are partially closed by the rotation action of the rim 113 of the first open end 111 of the cylinder 110.

FIG. 3C shows the baffle member 100 in a closed arrangement closed by the two cone 121, 122 arrangement. The full rotation of the rim 113 results in the full closure of the leaves 222 of the diaphragm shutter 220.

Figure 4A:
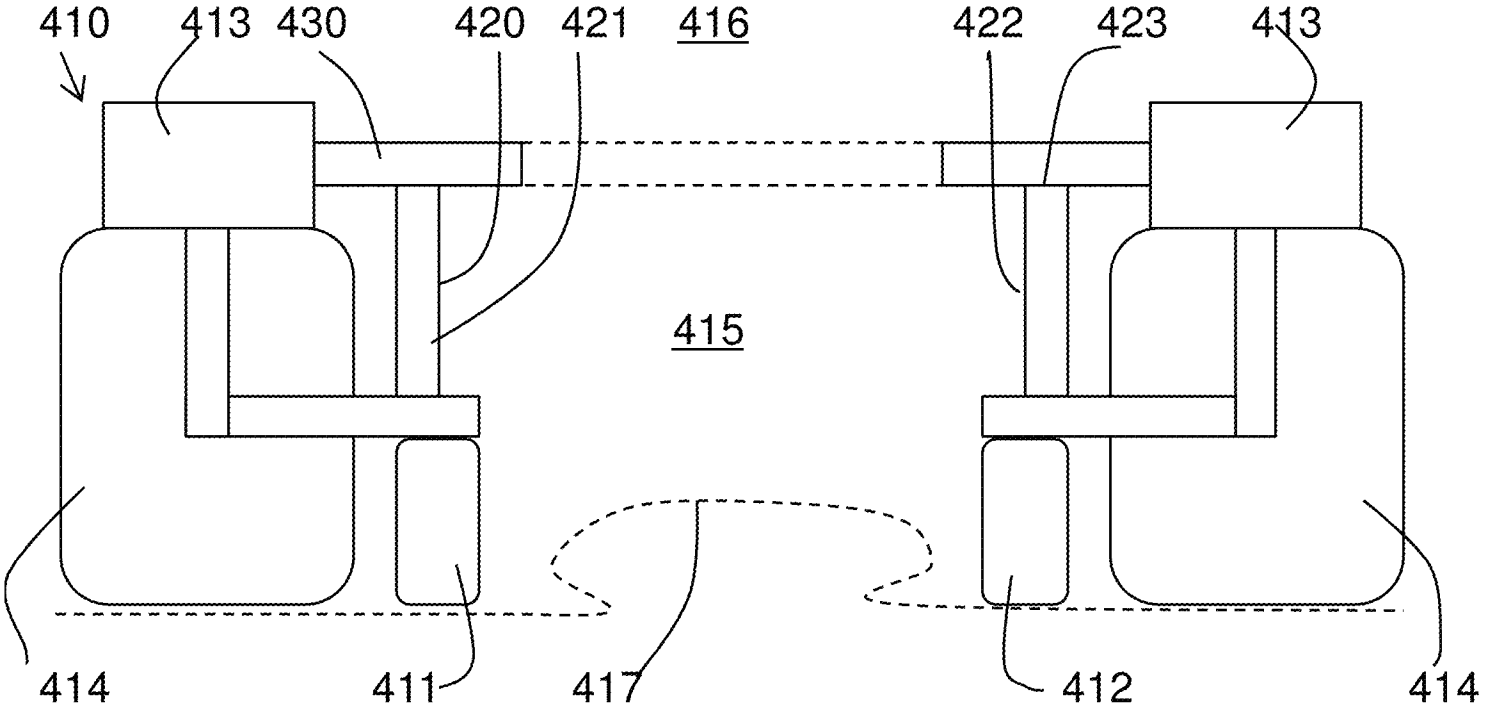
FIGS. 4A and 4B are cross-sections of an earphone apparatus in two different arrangements in accordance to an exemplary embodiment.
Figure 4B:
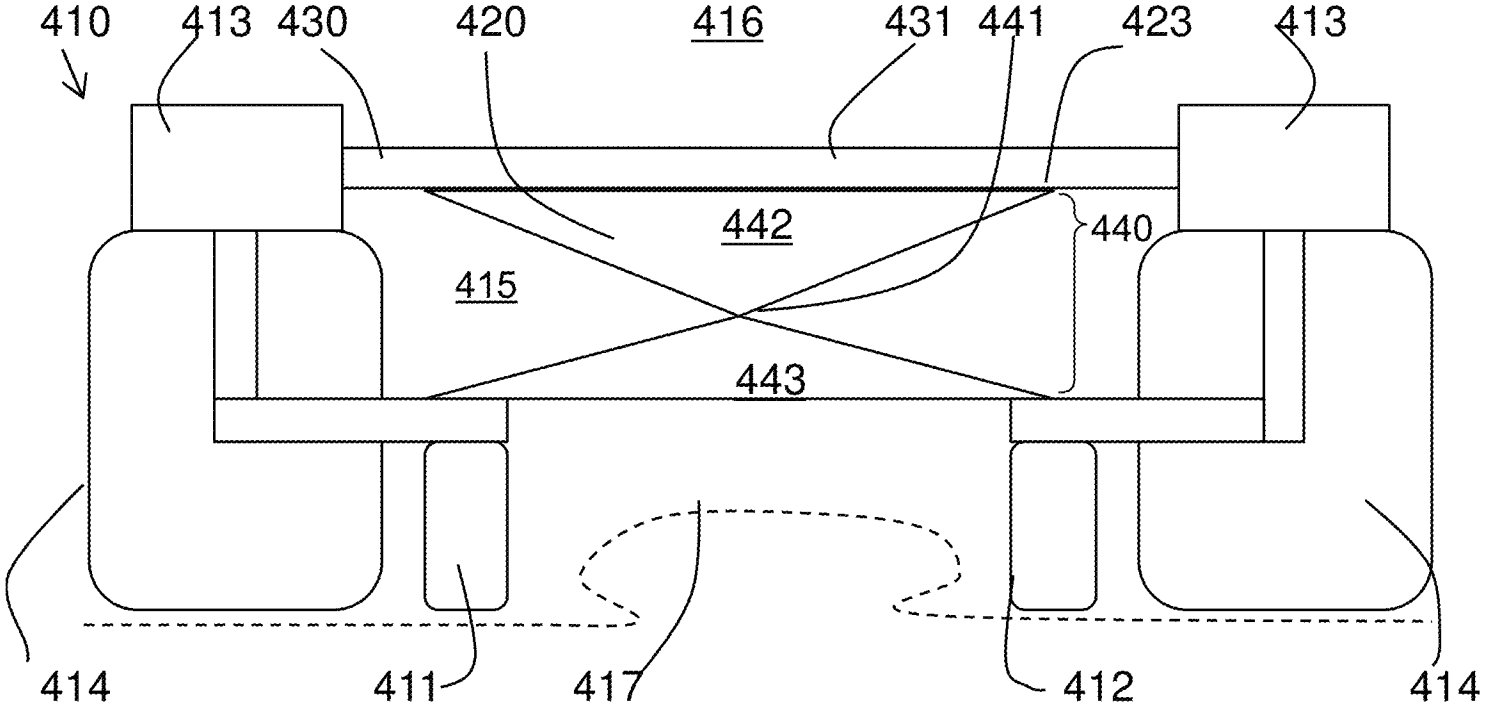

Referring to FIGS. 4A and 4B, an embodiment of an earphone apparatus 410 is shown in cross-section in an open arrangement and a closed arrangement respectively.

FIG. 4A shows an earphone apparatus 410 which may include a housing 413 that supports the components of the earphone apparatus 410. The housing 413 may have cushioning 414 which rests against the wearer's head and which may provide additional sound insulation. In an embodiment, a sound emitter component is provided in the form of bone conducting components 411, 412. In an embodiment, two bone conducting components 411, 412 are provided which receive and transmit sound to the wearer's head. The bone conducting components 411, 412 may be disposed either side of a central channel 415. The housing 413 may generally form the central channel 415 from the outside 416 of the earphone apparatus 410 to the wearer's ear 417. A baffle member 420 may be provided in the form of an open-ended cylinder surrounding the central channel 415. FIG. 4A shows the baffle member 420 in an open arrangement with a first side 421 and a second side 422 of the open-ended cylinder shown.

The baffle member 420 has a first open end 423 at the outer surface of the earphone apparatus 410 and a diaphragm shutter 430 may be provided to open and close at the first open end 423 of the baffle member 420. In FIG. 4A, the diaphragm shutter 430 is shown in an open position with its leaves retracted to cause the central channel 415 to be open allowing ambient noise external to the earphone apparatus 410 to reach the wearer's ear 417.

FIG. 4B shows the earphone apparatus 410 which may include the housing 413 that supports the components of the earphone apparatus 410. The housing 413 may have cushioning 414 which rests against the wearer's head and which may provide additional sound insulation. In an embodiment, a sound emitter component is provided in the form of bone conducting components 411, 412. In an embodiment, two bone conducting components 411, 412 are provided which receive and transmit sound to the wearer's head. The bone conducting components 411, 412 may be disposed either side of the central channel 415. The housing 413 may generally form the central channel 415 from the outside 416 of the earphone apparatus 410 to the wearer's ear 417.

Referring to FIG. 4B, the baffle member 420 may be twisted to change the open-ended cylinder shape into a closed arrangement of a double-cone shape 440 with a closure 441 between a top cone 442 and a bottom cone 443. The baffle member 420 may be twisted by rotating the first open end 423.

The diaphragm shutter 430 may be provided in cooperating operation with the baffle member 420 such that the rotating of the first open end 423 rotates the diaphragm shutter 430 to close the leaves 431 of the diaphragm shutter 430. In this way, the central channel 415 may be closed by both the baffle member 420 and the diaphragm shutter 430.

A further embodiment may optionally be provided by compressing the closed diaphragm shutter 430 towards the wearer's ear 417 such that the top cone 442 inverts over the bottom cone 443 to provide a double insulation and decreasing the resultant height of the earphone apparatus 410. The housing 413 may require modification to accommodate this embodiment.

As an alternative to the diaphragm shutter 420, a fixed member may be provided across the housing 413 at the outer surface of the earphone apparatus 410 and adjacent to the first open end 423. The fixed member may be of a material that is non-sound insulating with the sound insulation being solely provided by the open/closed position of the baffle member 420.

Figure 5A:
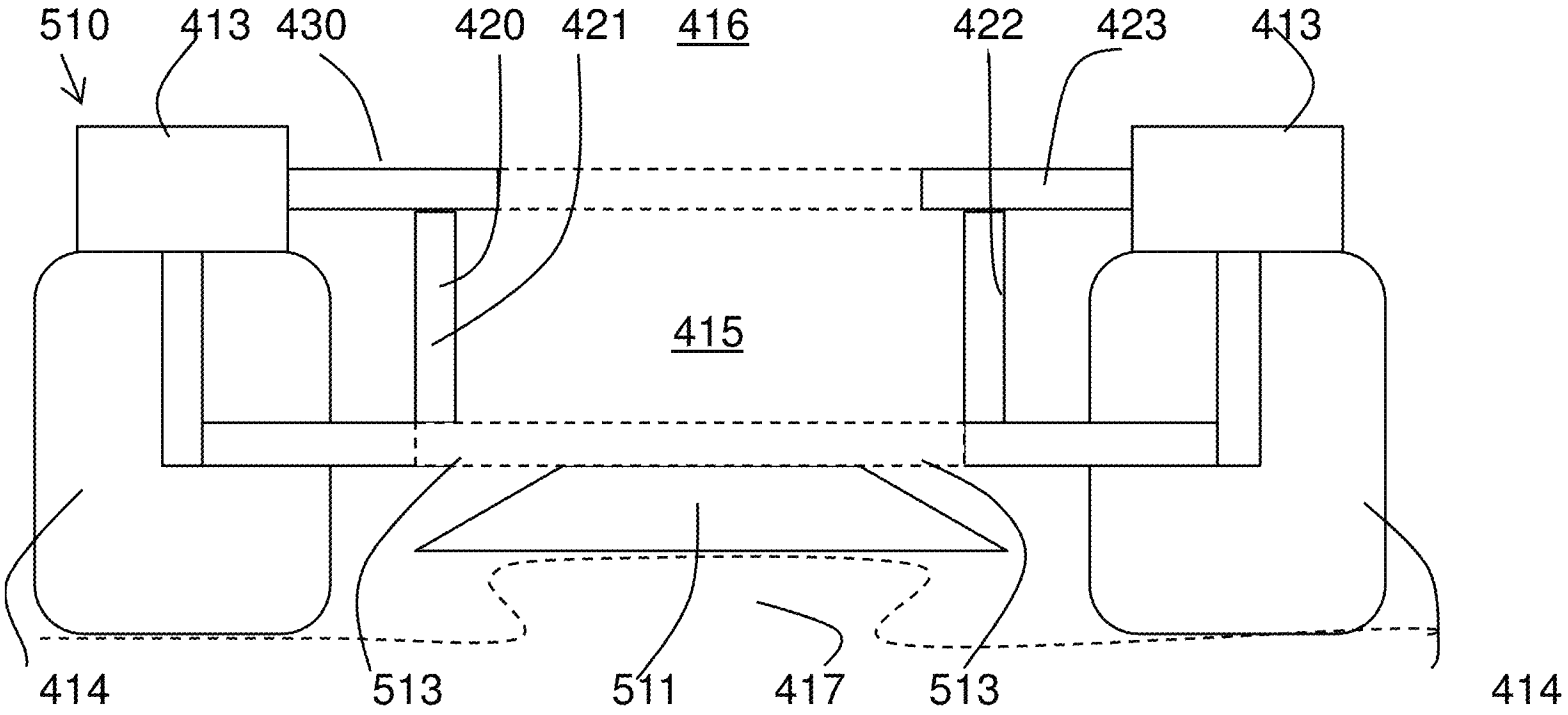
FIGS. 5A and 5B are cross-sections of an earphone apparatus in two different arrangements in accordance to an exemplary embodiment.
Figure 5B:
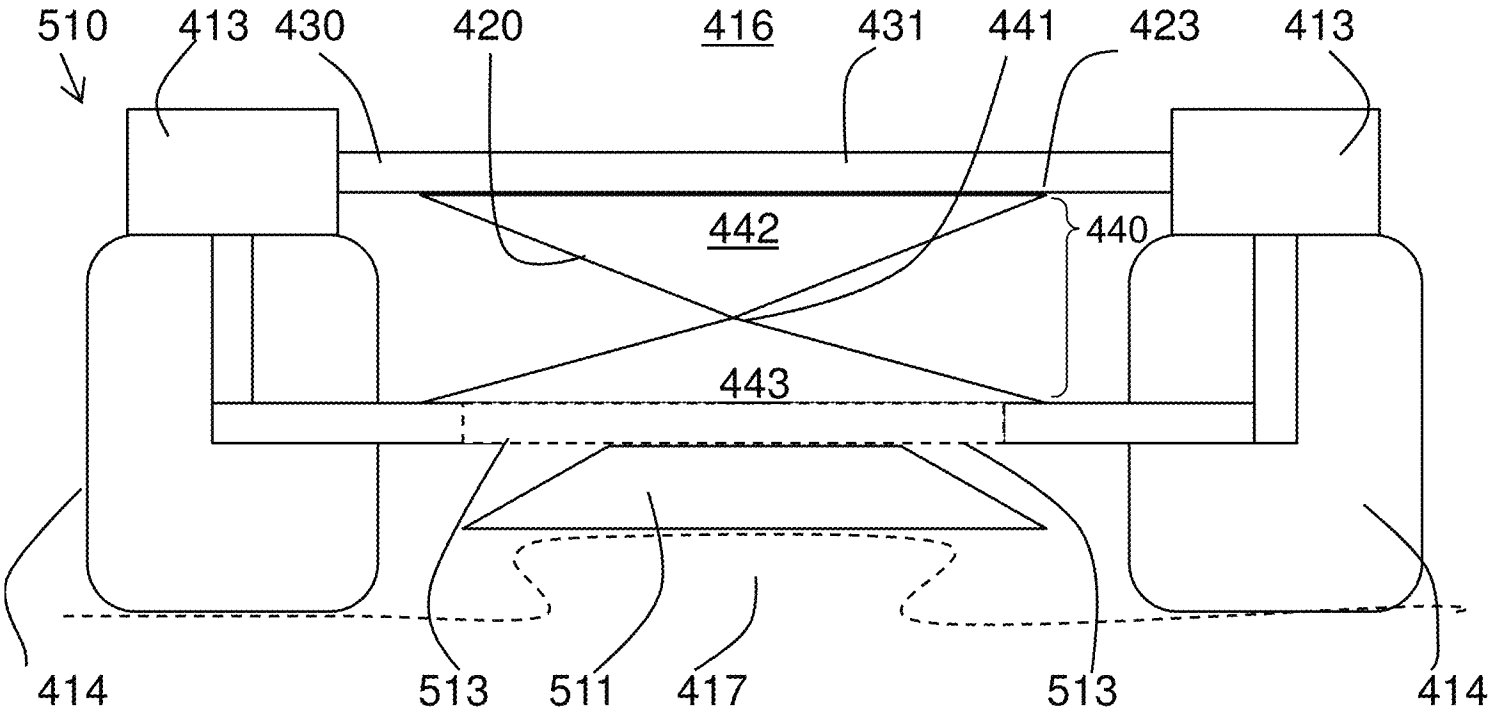

Referring to FIGS. 5A and 5B, a second embodiment of an earphone apparatus 510 is shown in cross-section in an open arrangement and a closed arrangement respectively. In this embodiment, a sound emitter component is provided in the form of a sound speaker component 511.

FIG. 5A shows the earphone apparatus 510 which may include the same features as the embodiment shown in FIGS. 4A and 4B with the exception of the bone conducting component 411, 412 which are replaced with a sound speaker component 511. Also shown is the housing 413 which supports the components of the earphone apparatus 510. The housing 413 may have cushioning 414 which rests against the wearer's head and which may provide additional sound insulation. The housing 413 may generally form the central channel 415 from the outside 416 of the earphone apparatus 410 to the wearer's ear 417. FIG. 5A shows the baffle member 420 in an open arrangement with a first side 421 and a second side 422 of the open-ended cylinder shown. The baffle member 420 has a first open end 423 at the outer surface of the earphone apparatus 510 and the diaphragm shutter 430 may be provided to open and close at the first open end 423 of the baffle member 420.

The sound speaker component 511 may be offset from the central channel 415 or is arranged such that there is at least one opening 513 adjacent the sound speaker component 511 through which sound may travel when the baffle member 420 and the diaphragm shutter 430 is in the open arrangement and the central channel 415 is open to allow ambient sound to the wearer's ear 417.

FIG. 5B shows the earphone apparatus 510 which may include the same features as the embodiment shown in FIGS. 4A and 4B with the exception of the bone conducting component 411, 412 which are replaced with a sound speaker component 511. Also shown is the housing 413 which supports the components of the earphone apparatus 510. The housing 413 may have cushioning 414 which rests against the wearer's head and which may provide additional sound insulation. The housing 413 may generally form the central channel 415 from the outside 416 of the earphone apparatus 410 to the wearer's ear 417.

Referring to FIG. 5B, the baffle member 420 may be twisted to change the open-ended cylinder shape into a closed arrangement of a double-cone shape 440 with a closure 441 between a top cone 442 and a bottom cone 443. The baffle member 420 may be twisted by rotating the first open end 423. The baffle member 420 has a first open end 423 at the outer surface of the earphone apparatus 510 and the diaphragm shutter 430 may be provided to open and close at the first open end 423 of the baffle member 420.

The diaphragm shutter 430 may be provided in cooperating operation with the baffle member 420 such that the rotating of the first open end 423 rotates the diaphragm shutter 430 to close the leaves 431 of the diaphragm shutter 430. In this way, the central channel 415 may be closed by both the baffle member 420 and the diaphragm shutter 430.

The sound speaker component 511 may be offset from the central channel 415 or is arranged such that there is at least one opening 513 adjacent the sound speaker component 511 through which sound may travel when the baffle member 420 and the diaphragm shutter 430 is in the open arrangement and the central channel 415 is open to allow ambient sound to the wearer's ear 417.

The rotation of the diaphragm shutter 430 is linked so as to cause a rotation of the baffle member 420 such that the open tube becomes closed off. The additional compaction stage would result from the diaphragm shutter being pressed towards the sound emission component (and wearer's head) such that the baffle member collapses.

Figure 6:
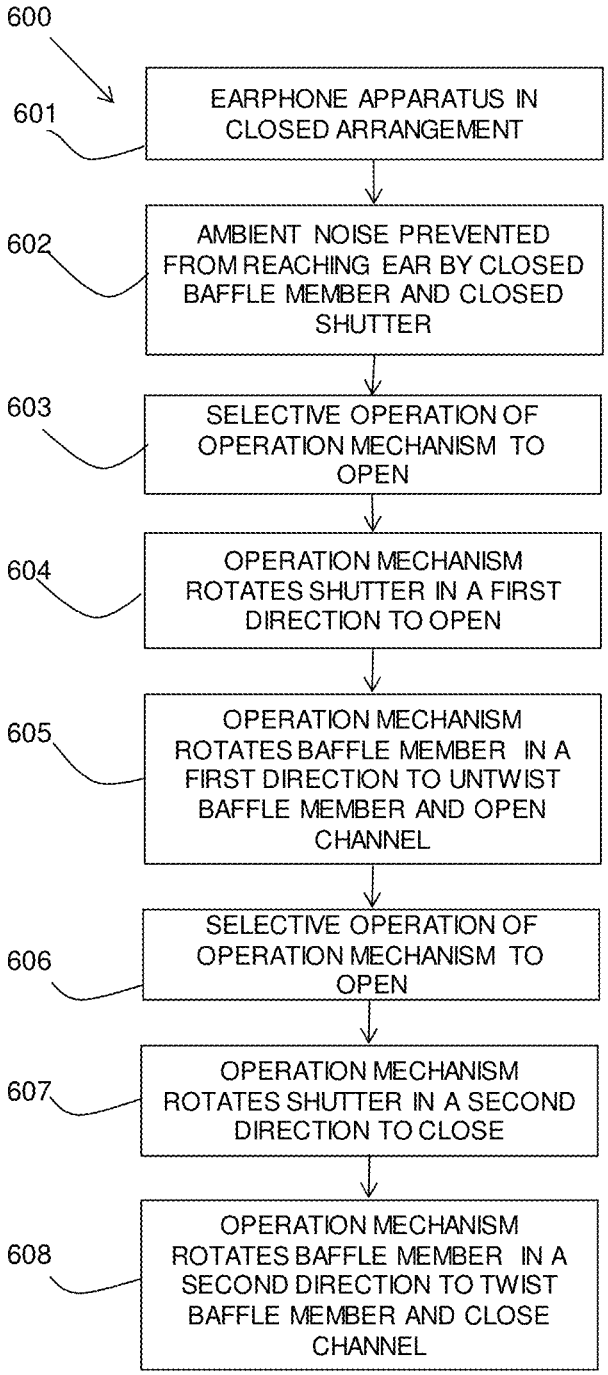
FIG. 6 is a flow diagram of a method of operation of the earphone apparatus in accordance to an exemplary embodiment.

Referring to FIG. 6, a flow diagram 600 describes the method of operation of an earphone apparatus as described herein.

An earphone apparatus may be provided in a closed arrangement in which a diaphragm shutter is closed and a baffle member is twisted into a closed position, step 601. The ambient noise outside the earphone apparatus is prevented from reaching the wearer's ear by the closed arrangement, which may also prevent reflected noise from the diaphragm shutter reaching the wearer's ear, step 602.

An operation mechanism may be selectively operated to open the central channel to allow ambient sound to reach the wearer's ear, step 603. This may be by manual operation or by electro-mechanical activation. The operation mechanism rotates the diaphragm shutter in a first direction to open the leaves of the shutter, step 604. The rotation of the diaphragm shutter also rotates the rim of the baffle member in the first direction to un-twist it to open the central channel, step 605.

The operation mechanism may be selectively operated to close the central channel to again prevent ambient sound from reaching the wearer's or user's ear, step 606. The operation mechanism rotates the diaphragm shutter in a second direction, opposite to the first direction, to close the leaves of the shutter, step 607. The rotation of the diaphragm shutter also rotates the rim of the baffle member in the second direction to re-twist the baffle member to close the central channel, step 608.

The baffle member may be provided as a separate insert for applying or incorporating into an earphone apparatus. The baffle member may be provided in conjunction with an operating mechanism and shutter arrangement. The baffle member may be retrofitted to an existing set of headphones.

A user may put on headphones that are in the closed position where the diaphragm shutter and baffle member are closed. The user may become aware of a prompt, for example, a visual cue or other sensory perception, and the user may wish to listen to the outside world. The user may press a button or other similar input device and the diaphragm mechanism for the shutter opens whilst simultaneously un-twisting the baffling allowing it to return to its original shape.

The user may listen to the ambient sound in the outside world, with the shutter now fully open. The user may choose to switch the audio of the headphones off as well.

The user may listen to the headphones in the closed position by shutting the shutter whilst simultaneously twisting the baffle member to the closed position.

A set of headphones with earphone apparatus are described that open and shut unobstructing the ear when the listener wants to or needs to hear important audio in his/her environment.

The headphones include diaphragm shutters that can be electro-mechanically opened and shut and the headphone speaker may be bone conducting or conventional, either central or offset so as to not obstruct the ears.

The use and mechanism of a baffle member is described which may be provided by auxetic material that has a negative Poisson ratio. The material can be made from viable materials such as polymers foams that have good absorption properties. When the shutter shuts a cylindrical auxetics material is twisted on one rim so that it creates a double cone to completely encapsulate the ear. Due to the auxetic properties, where the material stretches it thickens providing increased insulation and stability to the structure.

Ambient sound attenuation may also be provided by the shutter. However, solid materials do reflect and absorb sounds, and the baffle member may absorb sounds in the chamber within the shutter. The baffle member may also absorb reflected sounds from the speakers.

The described apparatus enables unobstruction of an ear without removal of headphones from the wearer's ears, providing clear audio input from outside the headphones. The headphones may operate as open or closed system headphones which may dynamically change from one to the other.

In a further embodiment, the described headphones may be combined with augmented reality glasses, for instance for listening to embedded media.

An application of the headphones may be in call centers where the current solution is to have an ear open at all times, which is not conducive to customer service. If for instance someone comes along and wishes to talk face-to-face with an operator, the headphone shutters and baffle members can be opened for a conversation.

Another application may be a pilot who needs to alternately listen to traffic control and to their copilot for information, the pilot may use the described headphone apparatus and keep their hands on the controls.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Improvements and modifications can be made to the foregoing without departing from the scope of the present invention.

What is claimed is:

1. A headphone apparatus including an earphone apparatus comprising:

a housing shaped to substantially cover an ear of a wearer when the headphone apparatus is worn; a sound emitting component within the housing; a baffle member formed of flexible, sound-insulating material in the form of a tube having an outer open end and an inner open end with a central axis through the tube, the baffle member has an open arrangement with the tube providing an open channel and a closed arrangement in which the baffle member is twisted about the central axis to form a closed neck in the baffle member thereby preventing sound from transmission through the tube;

and an operating mechanism for switching the baffle member between the open arrangement and the closed arrangement.

2. The headphone apparatus as claimed in claim 1, wherein the tube is an open-ended cylinder and wherein the closed arrangement has two opposing cones with a common apex, wherein the apex closes the baffle member when the outer open end and the inner open end are rotated relatively by at least 180 degrees.

3. The headphone apparatus as claimed in claim 2, wherein the baffle member has a third arrangement in which one of the opposing cones of the baffle member is inverted over the other to reduce a height of the baffle member.

4. The headphone apparatus as claimed in claim 1, wherein the tube is an open-ended prism having polygon shaped open ends and wherein the closed arrangement forms a twisted prism, wherein the twisted prism closes the baffle member.

5. The headphone apparatus as claimed in claim 1, further comprising: a shutter disposed adjacent the outer open end of the baffle member for closing the outer open end when the baffle member is in the closed arrangement.

6. The headphone apparatus as claimed in claim 5, wherein the shutter is a diaphragm shutter and closes the outer open end by rotation of the diaphragm shutter.

7. The headphone apparatus as claimed in claim 6, wherein the closed arrangement in which the baffle member is twisted about the central axis comprises rotating the outer open end whilst the inner open end remains in a fixed position; and the rotation of the outer open end also rotates the diaphragm shutter.

8. The headphone apparatus as claimed in claim 1, wherein the sound emitting component comprises a bone conduction component for conduction of sound to an inner-ear through the bones of a wearer's skull.

9. The headphone apparatus as claimed in claim 1, wherein the sound emitting component comprises a sound speaker component for emitting sound to an outer ear of the wearer, and wherein an opening is provided between the sound speaker component and the inner open end of the baffle member.

10. The headphone apparatus as claimed in claim 1, wherein the baffle member is comprises an auxetic material with a negative Poisson ratio.

11. The headphone apparatus as claimed in claim 1, wherein the operating mechanism comprises at least one of a manual rotation mechanism and an electro-mechanical mechanism.

12. The headphone apparatus as claimed in claim 1, further comprising two earphone apparatus.

13. The headphone apparatus as claimed in claim 12, wherein then operating mechanism operates at least one of the earphone apparatus.

14. A method of operating a headphone apparatus, comprising: operating an operating mechanism of an earphone apparatus to open or close a channel to allow or prevent sound to pass through the earphone apparatus; the operating mechanism rotating a baffle member provided within the earphone apparatus between an open arrangement and a closed arrangement wherein the baffle member comprises flexible, sound-insulating material in the form of a tube having an outer open end and an inner open end with a central axis through the tube, the baffle member comprising an open arrangement with the tube providing an open channel and a closed arrangement in which the baffle member is twisted about the central axis to form a closed neck in the baffle member thereby preventing sound from transmission through the tube.

15. The method as claimed in claim 14, wherein the operating mechanism rotates a shutter between an open position and a closed position across an opening of the outer open end of the baffle member.

16. The method as claimed in claim 15, wherein the closed arrangement in which the baffle member is twisted about the central axis comprises rotating the outer open end whilst the inner open end remains in a fixed position; and the rotation of the outer open end also comprises rotating the shutter in the form of a diaphragm shutter.

17. The method as claimed in claim 14, wherein the method comprises the operating mechanism providing a force on the baffle member to invert an opposing portion of the twisted tube over another portion of the twisted tube to reduce a height of the baffle member.

18. The method as claimed in claim 14, wherein the operating mechanism comprises at least one of a manual rotation mechanism and an electro-mechanical mechanism.

19. An earphone insert comprising: a baffle member comprising flexible, sound-insulating material in the form of a tube, comprising an outer open end and an inner open end with a central axis through the tube, the baffle member has an open arrangement with the tube providing an open channel and a closed arrangement in which the baffle member is twisted about the central axis to form a closed neck in the baffle member thereby preventing sound from transmission through the tube.

20. The earphone insert as claimed in claim 19, further comprising: an operating mechanism for operating switching of the baffle member between the open arrangement and the closed arrangement; and a shutter adjacent the outer open end of the baffle member for closing the outer open end when the baffle member is in the closed arrangement.

* * * * *